US005687677A

United States Patent [19]

Oslin

[11] Patent Number: 5,687,677

[45] Date of Patent: Nov. 18, 1997

[54] HEAT EXCHANGE TUBE AND METHOD OF MAKING SAME

[75] Inventor: G. Robert Oslin, Chicago, Ill.

[73] Assignee: Delaware Capital Formation, Inc., Wilmington, Del.

[21] Appl. No.: 684,511

[22] Filed: Jul. 18, 1996

Related U.S. Application Data

[63] Continuation of Ser. No. 443,414, May 22, 1995, abandoned.

[51] Int. Cl.[6] ..... F22B 9/00

[52] U.S. Cl. ..... 122/44.2; 122/155.2; 165/179; 29/890.049

[58] Field of Search ..... 126/20.1, 369; 122/44.2, 155.2; 165/179, 183, DIG. 520, DIG. 504; 29/890.049

[56] References Cited

U.S. PATENT DOCUMENTS

| | | | |
|---|---|---|---|
| 1,109,729 | 9/1914 | Winslow . | |
| 2,342,117 | 2/1944 | Brown, Jr. et al. . | |
| 2,731,709 | 1/1956 | Gaddis et al. | 165/179 |
| 2,930,405 | 3/1960 | Welsh . | |
| 3,267,564 | 8/1966 | Keyes . | |
| 3,587,531 | 6/1971 | Magnuson . | |
| 3,692,104 | 9/1972 | Gerstmann . | |
| 4,031,602 | 6/1977 | Cunningham et al. . | |
| 4,263,966 | 4/1981 | Östbo | 165/179 |
| 4,296,779 | 10/1981 | Smick . | |
| 4,352,378 | 10/1982 | Bergmann et al. . | |

*Primary Examiner*—Noah P. Kamen
*Attorney, Agent, or Firm*—Welsh & Katz, Ltd.

[57] ABSTRACT

An elongated heat exchange tube and method of making same are disclosed wherein a pair of elongated generally right-angle metallic wall members are adapted for mirror image connection to form an outer tube wall of generally rectangular transverse cross-section. A plurality of internal generally planar heat transfer fins having 90° weld flanges are secured to inner surfaces of the right-angle walls and define longitudinal flow passages through which heated combustion gases are passed to effect improved heat transfer to the outer peripheral wall of the heat transfer tube with enhanced heat convection to a medium in contact with the outer surface of the outer tube wall. A plurality of the heat exchange tubes may be mounted within a compact steam generator for highly efficient production of steam for a steam oven.

14 Claims, 2 Drawing Sheets

FIG. 1
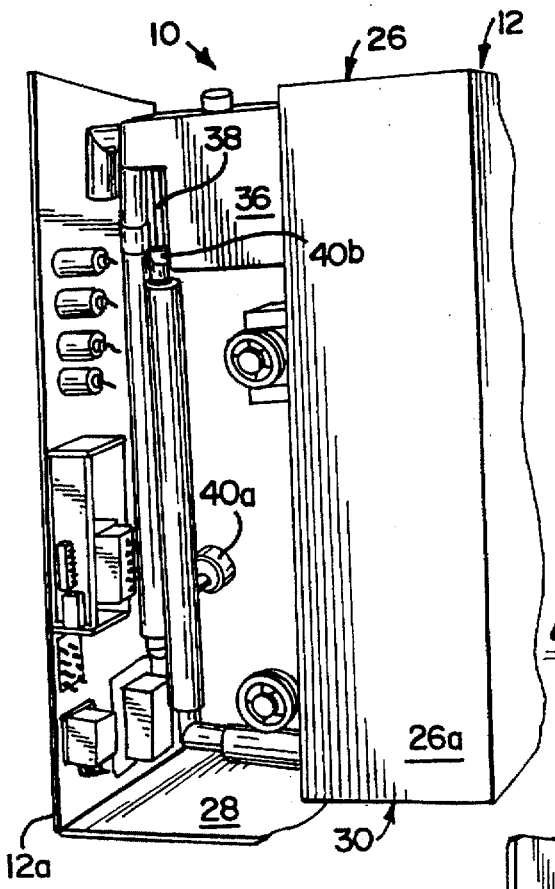
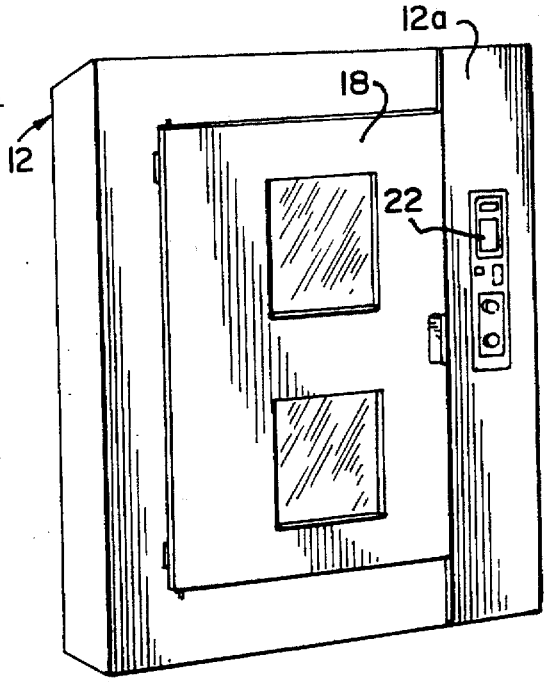
FIG. 2
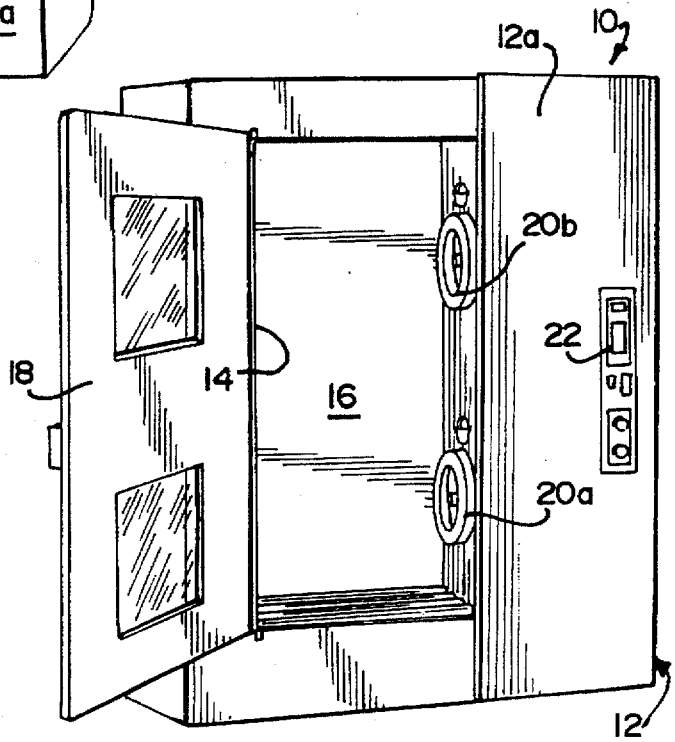
FIG. 3

HEAT EXCHANGE TUBE AND METHOD OF MAKING SAME

This application is a continuation of Ser. No. 08/443,414, filed May 22, 1995, now abandoned.

BACKGROUND OF THE INVENTION

The present invention relates generally to heat exchangers, and more particularly to a novel heat exchange tube and method of making same.

Commercial cooking ovens which utilize steam as a heat source to a cooking chamber, sometimes termed steam ovens or steamers, are known that employ a boiler or atmospheric steam generator to create steam which is passed into an oven cooking cavity or chamber or circulated within the cooking chamber. See, for example, U.S. Pat. Nos. 4,817,582 and 5,368,008 which are incorporated herein by reference and disclose gas-fired combination steamer/heated air ovens utilizing atmospheric steam generators for generating steam. The steam is circulated within the cooking chamber by fans. Typically, the steam generator or boiler includes a plurality of heat exchange tubes through which heated combustion gas is passed. It is a common practice in devices employing heat exchange tubes, particularly when the heat exchange tubes are relatively straight and vertically disposed, to improve their heat transfer characteristics by inserting fins or ribs internally of the heat exchange tubes so that the fins or ribs contact the tube wall and increase the heat transfer area with resultant greater heat transfer to and outwardly through the tube peripheral wall.

A desirable feature of commercial steam ovens is that they be relatively compact to facilitate passage through standard size door openings, such as 36 inch width, while providing maximum cooking chamber capacity. To meet this criteria, commercial ovens have been made to a limited depth enabling passage through door openings. This presents a problem in that the space available for the steam generator is limited, thus limiting the heating capacity in Btu per hour of the steam generator. The present invention addresses this problem.

SUMMARY OF THE INVENTION

One of the primary objects of the present invention is to provide a novel and improved heat exchange tube and method of making same.

A more particular object of the present invention is to provide a novel heat exchange tube and method of making same wherein the heat exchange tube lends itself to use in a steam generator and has improved heat transfer characteristics, in Btu per hour, and a relatively compact transverse cross-section.

Another object of the present invention is to provide a novel heat exchange tube having a relatively small transverse cross-section which provides increased heat transfer area internally of the tube.

Still another object of the present invention is to provide a method for making an elongated heat transfer tube wherein a plurality of generally right-angle elongated metallic members are adapted for selective connection to form an outer tube wall of generally rectangular transverse cross-section having a plurality of internal longitudinal passages defined by generally right-angle planar metallic heat transfer surfaces such that heated combustion gas passed through the internal passages effects improved heat transfer to the outer wall with enhanced heat convection to a medium in contact with the outer surface of the outer tube wall.

In carrying out the invention, a heat exchange tube and method of making the same are provided wherein a pair of substantially identical elongated right-angle metallic outer wall members having connecting flanges formed along their free marginal edges are adapted for mirror image connection, as by a continuous weld along their mutually facing connecting flanges, to form an outer rectangular tube wall. Prior to connecting the outer wall members to each other, a plurality of internal elongated right-angle metallic heat transfer fin members having connecting flanges along longitudinal marginal edges are fixed internally of each of the outer wall members, as by spot welding. When the outer wall members are connected to each other along their mutually opposed connecting flanges, the internal heat transfer fin members cooperate to define a plurality of internal longitudinal flow passages bounded by generally planar heat transfer fin surfaces providing increased heat transfer to the outer tube walls when a combustion gas is passed through the internal flow passages.

In an alternative embodiment, the internal heat transfer fins may be formed as generally planar metallic fin members having right-angle connecting flanges facilitating connection to internal surfaces of the right-angle outer tube walls. The fin members are sized for mutual cooperation to form internal flow passages when the outer tube wall members are connected along their longitudinal connecting flanges.

A significant advance provided by the heat exchange tubes of the present invention lies in the ability to assemble a plurality of the heat exchange tubes in closely spaced parallel relation internally of a steam generator so as to provide improved heat convection to water or other fluid medium flowing along the outer peripheries of the heat exchange tubes, thereby providing increased Btu per hour in a compact space.

A feature of the heat transfer tubes in accordance with the present invention lies in the ability to provide a compact highly efficient steam generator for use in an oven so as to minimize the space taken by the steam generator and optimize the cooking chamber capacity.

Further objects, features and advantages of the present invention, together with its organization and manner of operation thereof, will become apparent from the following detailed description of the invention taken in conjunction with the accompanying drawings wherein like reference numerals designate like elements throughout the several views.

BRIEF DESCRIPTION OF THE DRAWINGS

FIG. 1 is a perspective view of an oven having a steam generator embodying the present invention;

FIG. 2 is a side view of the oven of FIG. 1 with the side plate removed to expose the steam generator employing heat exchange tubes in accordance with the present invention;

FIG. 3 is a perspective view of the oven of FIG. 3 but with the front access door open to expose internal steam circulating fans, internal shelving and support structure being removed for clarity;

DETAILED DESCRIPTION

Figure 4:
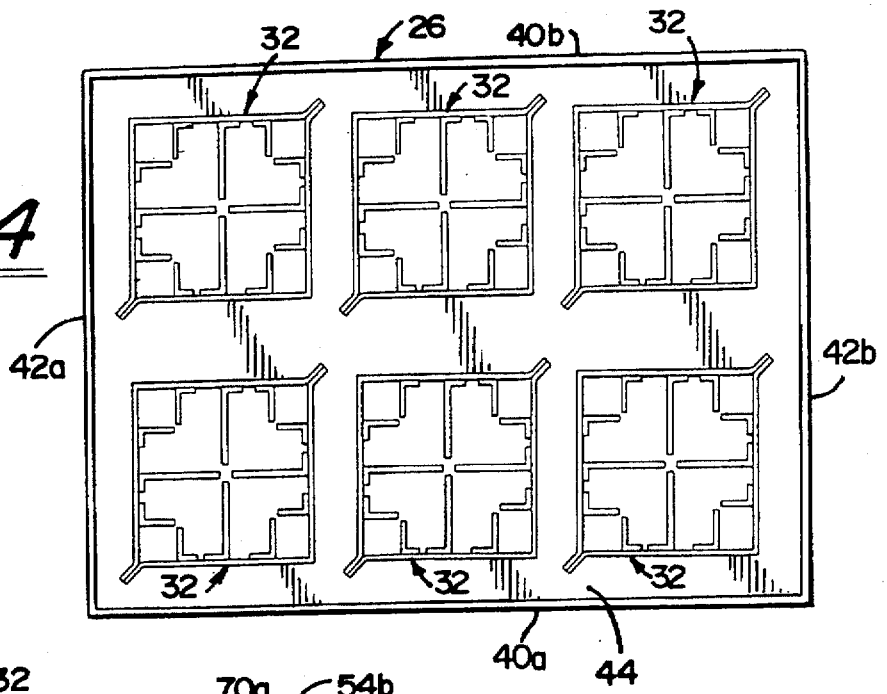
FIG. 4 is an end view of the upper end of the steam generator of FIG. 2 but with the upper end plate removed to expose the upper ends of the internal heat exchange tubes.

Referring now to the drawings, and in particular to FIG. 1, an oven employing a gas-fired steam generator having internal heat exchange tubes in accordance with the present invention is indicated generally at 10. The oven 10 is preferably of a stainless steel construction and has an outer generally rectangular housing, indicated generally at 12, having a front panel 12*a* defining a rectangular access opening 14 to an internal oven chamber or cavity 16. A door 18 is hinged to the oven housing and adapted to be latched in a closed sealed position. The oven cavity or chamber 16 is suitably insulated and is adapted to receive a pan support rack system (not shown) to facilitate support of a plurality of cooking pans in horizontally disposed vertically spaced relation within the oven cavity. A pair of rotary impeller-type fan or blower wheels 20*a* and 20*b* are supported on a right-hand wall 16*a* of the oven cavity and driven by suitable electric drive motors to facilitate circulation of steam within the oven cavity when the oven is used in a steamer mode. A plurality of heat convection tubes (not shown) extend along the lower region of the oven below the oven cavity, vertically upwardly along and rearwardly of a left-hand cavity wall and generally horizontally across the top of the oven cavity to a discharge duct or vent. The convection tubes are adapted to receive heated flue gases to heat air within the oven cavity circulated by the blowers 20*a* and 20*b* when the oven is operated in a hot-air cooking mode. The oven may also be used as a combination steamer/oven wherein food items or the like to be cooked within the oven cavity or chamber 16 are heated by a combination of steam and hot air. A control panel 22 is mounted on the front panel 12*a* of the oven housing and has a digital timer and touch pad switches for on/off and mode selection control, and a knob set temperature control.

One feature of the oven 10 in accordance with the present invention lies in the provision of a compact atmospheric steam generator as indicated generally at 26 in FIG. 2. The steam generator 26 has a vertically elongated configuration and is substantially rectangular in transverse cross-section. The steam generator is relatively compact to enable support within an insulated combustion chamber 28 formed within the right-hand end of the oven housing 12. A vertical outer end wall is removed from FIG. 2 for clarity. The steam generator 26 extends substantially the full height of the oven 10 with its lower end 26*a* being positioned over a multi-burner heating unit 30 having a plurality of combustion nozzles adapted to discharge ignited combustion gas upwardly through a plurality of vertically disposed substantially identical heat exchange tubes each of which is indicated generally at 32 in FIG. 4.

A rectangular separator 36 is fixed to an upper sidewall of the steam generator 26 and is adapted to separate water droplets from steam received from the steam generator so that steam enters a downrunner tube 38 and enters the oven cavity 16 through tubular T-shaped inlet connections, indicated at 40*a* and 40*b* in FIG. 2, to a pair of vertically spaced discharge ports formed in the vertical right-hand side wall of the oven chamber adjacent the blowers 20*a* and 20*b*. Water condensate within the separator 36 also passes down the downrunner tube 38 and is conveyed back to the bottom of the steam generator 26 which is also connected a water supply (not shown) adapted to introduce water under pressure to the lower end of the steam generator so that the water flows upwardly over the outer peripheral surfaces of the heat exchange tubes 32. In this manner, heat generated by the heat exchange tubes is convected into the water to produce steam which enters into the separator and passes into the oven chamber during a steam cooking mode.

Figure 5:
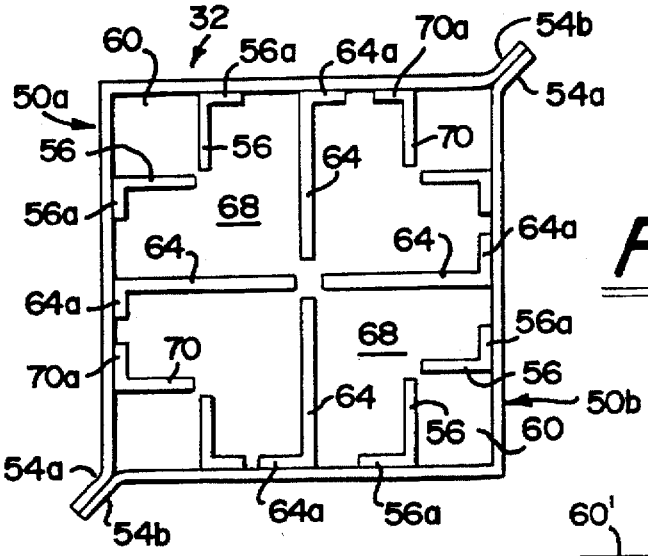
FIG. 5 is a transverse sectional view, on an enlarged scale, of a heat exchange tube as employed in the steam generator of FIG. 4.

Referring particularly to FIG. 5, taken in conjunction with FIGS. 2 and 4, the illustrated steam generator 26 is generally rectangular in transverse cross-section so as to define laterally opposite generally planar walls 40*a* and 40*b* which are connected at their longitudinal edges to transverse end walls 42*a* and 42*b* to define a closed internal chamber in which the heat exchange tubes 32 are mounted. As illustrated in FIG. 4, the heat exchange tubes 32 are also of substantially rectangular transverse cross-sectional configuration, such as being substantially square in cross-section, and are supported within the outer wall of the steam generator 26 so that the heat exchange tubes are in relatively closely spaced parallel relation to each other and to the side walls of the steam generator. The upper and lower ends of the heat exchange tubes having their peripheral walls sealingly connected to generally similar upper and lower planar end plates, the upper end plate being indicated at 44 in FIG. 4. The end plates are connected at their outer peripheral edges to the side walls 40*a,b* and 42*a,b* of the steam generator in liquid tight or sealed relation therewith. Similarly, the end plates of the steam generator have rectangular openings therethrough which receive the ends of the six parallel heat exchange tubes 32 and are connected thereto in fluid tight relation, such as by welding. In this manner, a fluid chamber is defined within the steam generator externally of the heat exchange tubes 32. Water entering the steam generator at its lower end passes upwardly along the heat exchange tubes to form steam in the upper region of the steam generator for passage through a suitable opening into the separator 36.

Each of the heat exchange tubes 32 includes a pair of substantially identical elongated outer wall members 50*a* and 50*b*. Each of the wall members 50*a,b* includes a pair of substantially planar interconnected right-angle walls 52*a* and 52*b* which are integrally connected at a right-angle corner. A pair of coplanar connecting or weld flanges 54*a* and 54*b* are formed along the free marginal edges of the walls 52*a,b* so that the connecting flanges extend the full longitudinal lengths of the outer wall members. The outer wall members 50*a* and 50*b* are adapted to be placed in mirror image relation with their connecting flanges 54*a* and 54*b* in mutually opposed relation enabling connection of the connecting flanges by a continuous weld to form a closed internal longitudinal chamber except for the open ends of the heat exchange tube. Prior to connecting the weld flanges 54*a,b* on a pair of outer wall members 50*a* and 50*b*, each of the outer wall members has a plurality of generally planar heat conducting fins fixed to the inner surfaces of the right-angle walls. The internal fins establish a plurality of discrete flow passages internally of the heat exchange tubes when the outer wall members 50*a,b* are affixed together with their connecting flanges 54*a,b* in mutually opposed welded relation.

Referring to FIG. 5, the inner surface of each of the generally planar right-angle outer walls 52*a* and 52*b* first has a generally planar heat conducting metallic fin 56 secured thereto spaced from the right-angle corner, by a weld flange 56*a* formed at a 90° angle to the planar fin 56 and which facilitates attachment to the inner surface of the corresponding side wall by spot welding. The planar fins 56 and 58 lie at right-angles to each other and have their free marginal longitudinal edges closely spaced to define a generally rectangular flow passage 60 extending the full longitudinal length of the outer wall member 50*a*. As seen in FIG. 5, the heat transfer fins 56 are oriented so that their welding flanges 56*a* are directed toward the connecting flanges 54*a* and 54*b*, respectively, to thereby provide each access for spot welding.

After securing the heat transfer fins 56 to the inner surfaces of the right-angle walls 52*a* and 52*b*, a second pair of larger size generally planar metallic heat transfer fins 64 are fixed to the inner surfaces of the right-angle walls 52*a* and 52*b* through 90° weld flanges 64*a* as by spot welding. The heat transfer fins 64 are similarly oriented such that their 90° weld flanges 64*a* are directed toward the connecting flanges 54*a* and 54*b*, respectively, thus enabling direct access for spot welding. The heat transfer fins 64 also have their longitudinal free edges in closely spaced relation and cooperate with the heat transfer fins 56 to define a discrete flow passage 68 extending longitudinally of the right-angle outer walls 52*a,b*.

After fixing the planar heat transfer fins 64 to the inner surfaces of the right-angle walls 52*a* and 52*b*, a third pair of generally planar metallic heat transfer fins 70 are attached to the inner surfaces of the walls 52*a,b*, respectively, as by 90° weld flanges 70*a*. The heat transfer fins 70 are of substantially equal size to the heat transfer fins 56 and have their weld flanges 70*a* extending in an opposite direction to the weld flanges on the heat transfer fins 64 but readily accessible for spot welding.

With each of the elongated outer wall members 50*a* and 50*b* having internal heat transfer fins 56, 64 and 70 affixed thereto as aforedescribed, the outer tube members may be positioned in mutually opposed relation so that their connecting flanges 54*a* and 54*b* are in contacting relation facilitating a fluid tight connection as by a continuous weld along the length of the flanges 54*a* and 54*b*. As described, the internal heat transfer fins 56, 64 and 70 are sized so that their free longitudinal edges are in closely spaced relation when the outer wall members 50*a* and 52*a* are secured together, thereby defining discrete flow passages along the longitudinal length of the heat exchange tube for passage of hot combustion gases from the combustion nozzles of the heating unit 30. The various components of the heat exchange tubes 32 are preferably made of a corrosion resistant stainless steel such as 304 L stainless steel.

With a plurality of the heat exchange tubes 32 being fixed internally of the outer walls of the rectangular steam generator 26, it will be appreciated that combustion gases passed upwardly through the heat exchange tubes effect heat transfer through the various internal heat transfer fins to the outer walls of the heat exchange tubes and thereby effect heat convection to water or other liquid medium passing upwardly within the steam generator peripherally of the heat exchange tubes. In this manner, a highly efficient compact steam generator is provided for the oven 10 which minimizes space requirements for the steam generator and thereby enables optimum oven cavity or chamber size.

Figure 6:
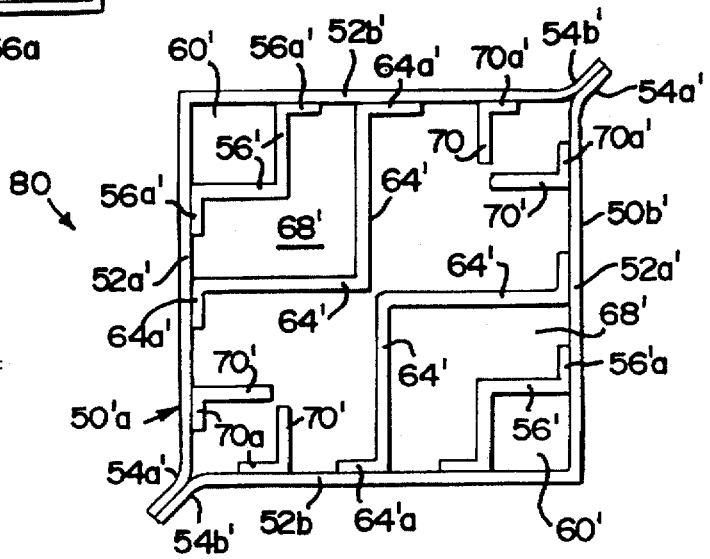
FIG. 6 is a transverse sectional view of an alternative heat exchange tube in accordance with the present invention.

FIG. 6 illustrates an alternative heat exchange tube, indicated generally at 80, for use within the steam generator 26 as an alternative to the heat exchange tubes 32. The heat exchange tube 80 is also made of separate mirror image elongated outer tube or wall members, indicated at 50'*a,b*, which may be fixed in mutually opposed mirror relation through coplanar connecting flanges 54'*a,b* formed integral with longitudinal marginal edges of right-angle walls 52'*a,b* in similar fashion to the heat exchange tubes 32. In the embodiment illustrated in FIG. 6, the internal heat transfer fins 56 and 64 are connected at their free longitudinal marginal edges so as to form integral right-angle walls having 90° weld flanges formed thereon to facilitate spot welding and thereby integral connection to the inner surfaces of the right-angle walls 52'*a,b* in similar fashion to attaching the heat transfer fins 56 and 64 to the right-angle walls 52*a,b* of the heat exchange tubes 32. A pair of generally planar heat exchange fins 70' having 90° weld flanges 70'*a* are similarly spot welded to the inner surfaces of the right-angle walls 52'*a,b* similar to the heat transfer fins 70 in the heat exchange tubes 32. In this manner, a pair of the substantially identical right-angle walls 52'*a,b* and their internal heat transfer fins may be secured together through the connecting flanges 54'*a,b* to establish discrete flow passages longitudinally of the heat exchange tube 80 to receive combustion gases therethrough and effect enhanced heat transfer to the outer wall of the heat exchange tube for convection to liquid medium in contact with the outer surfaces of the heat exchange tubes. A plurality of the heat exchange tubes 80 may be similarly mounted internally of a steam generator to provide a similarly compact steam generator for use with the oven 10 to optimize oven cavity size.

Thus, in accordance with the present invention, alternative embodiments of heat exchange tubes are provided which have substantially rectangular transverse cross-sectional configurations and which have enhanced heat transfer characteristics due to generally planar heat conducting fin surfaces formed internally of the heat transfer tubes in heat transfer connection to the outer walls of the heat transfer tubes. This enhances heat convection to liquid or other fluid medium contacting the outer peripheral surfaces of the heat exchange tubes when mounted within a steam generator.

By forming the heat exchange tubes as aforedescribed, manufacture of the heat exchange tubes is greatly facilitated by providing ready access to 90° weld flanges formed on the internal generally planar heat transfer fins for welding or otherwise affixing them in heat transfer relation to inner surfaces of the right-angle outer walls. A pair of generally identically shaped halves of each heat exchange tube may be secured together in fluid tight relation as by continuous welding of their mutually opposed connecting flanges. Similarly, the heat exchange tubes enable a very compact and highly efficient steam generator to be provided in an oven or steamer to optimize the cooking chamber cavity size.

While preferred embodiments of the present invention have been illustrated and described, it will be understood that changes and modifications may be made therein without departing from the invention in its broader aspects. Various features of the invention are defined in the following claims.

What is claimed is:

1. A steam generator comprising, in combination, a plurality of substantially identical elongated heat exchange tubes each of which has an outer wall of generally rectangular transverse cross-section, an outer shell extending peripherally about said heat exchange tubes, upper and lower end plates having openings receiving upper and lower ends of said heat exchange tubes in fluid tight relation therewith, said upper and lower end plates maintaining said tubes in parallel spaced relation and being secured to said outer shell so as to establish a fluid chamber about said heat exchange tubes, each of said heat exchange tubes having a plurality of internal generally right-angle fins secured to inner surfaces of said outer wall so as to define a plurality of discrete longitudinal flow passages through which a heated gas may be passed with said internal fins effecting heat transfer to said outer wall so as to convect heat to a fluid disposed within said fluid chamber.

2. A steam generator as defined in claim 1 wherein said outer shell has a substantially rectangular transverse cross-sectional configuration.

3. A steam generator as defined in claim 2 wherein said heat exchange tubes are oriented so that their outer side walls are parallel to side walls of said outer shell.

4. A heat exchange tube comprising a pair of substantially identical elongated outer wall members each of which includes a pair of substantially planar interconnected right-angle walls having connecting flanges formed along longitudinal marginal edges, said connecting flanges being secured in mutually opposed relation so as to form an outer tube having a substantially rectangular transverse cross-section, a plurality of generally planar fin members secured to internal surfaces of said outer wall members so as to establish a plurality of discrete flow passages internally of the heat exchange tube.

5. A method of making an elongated heat exchange tube having a generally rectangular transverse cross-sectional configuration, said method comprising the steps of:

forming a pair of substantially identical right-angle outer metallic wall members having connecting flanges formed along longitudinal marginal edges, securing a plurality of generally planar heat conducting metallic fin members to inner surfaces of said outer wall members, said fin members having right-angle weld flanges thereon enabling welding to said inner surfaces of said outer wall members, and securing said outer wall members to each other in mirror image relation through said connecting flanges, said internal fins being sized to define a plurality of longitudinal flow passages internal of the heat exchange tube.

6. A method of claim 5 wherein selected ones of internal fin members are formed as right-angle fins having weld flanges formed along longitudinal marginal edges.

7. The method of claim 5 wherein said right-angle outer wall members and inner fin members are made from stainless steel.

8. The method of claim 5 wherein said internal fin members are secured to said inner surfaces of said outer wall members in a predetermined sequence so as to enable free access to their weld flanges for welding to said outer walls.

9. A heat exchange tube comprising a pair of substantially identical elongated outer wall members each of which includes a pair of interconnected generally right-angle walls having connecting flanges formed along longitudinal marginal edges, said connecting flanges being secured in mutually opposed relation so as to form an outer tube having a longitudinal axis, a plurality of elongated fin members secured to internal surfaces of said outer wall members and extending generally parallel to said longitudinal axis so as to establish a plurality of discrete flow passages internally of the heat exchange tube.

10. A heat exchange tube as defined in claim 9 wherein said generally right-angle walls of each pair of interconnected generally right-angle walls comprise substantially equal size planar walls.

11. A heat exchange tube as defined in claim 9 wherein said elongated wall members are configured to create an outer tube having a substantially square transverse cross section when said connecting flanges are secured in mutually opposed relation.

12. A heat exchange tube as defined in claim 9 wherein selected ones of internal fin members are formed as right-angle fins having weld flanges formed along longitudinal marginal edges.

13. A heat exchange tube as defined in claim 12 wherein said internal fin members are of different size so as to enable at least two internal fins of different size to be secured to the inner surfaces of each pair of right-angle outer wall members in parallel spaced relation.

14. A heat exchange tube as defined in claim 9 wherein said outer wall members and elongated fin members are made from stainless steel.

* * * * *